US005209083A

United States Patent [19]

Wada et al.

[11] Patent Number: 5,209,083

[45] Date of Patent: May 11, 1993

[54] FLAT KNITTING MACHINE HAVING FUNCTION FOR ADJUSTING KNOCK-OVER TIMING

[75] Inventors: Takashi Wada; Shigeki Nakahara; Ryoichi Kubota, all of Wakayama, Japan

[73] Assignee: Shima Seiki Mfg., Ltd., Wakayama, Japan

[21] Appl. No.: 651,823

[22] Filed: Feb. 7, 1991

[30] Foreign Application Priority Data

Feb. 7, 1990 [JP] Japan ..... 2-27355

[51] Int. Cl.[5] ..... D04B 7/00

[52] U.S. Cl. ..... 66/90; 66/109

[58] Field of Search ..... 66/60 R, 60 H, 71, 77, 66/90, 95, 96 R, 104, 109, 208

[56] References Cited

U.S. PATENT DOCUMENTS 1,939,092 12/1933 Welffens ..... 66/109
2,682,163 6/1954 Staff et al. ..... 66/208
2,749,730 6/1956 Noe ..... 66/208
2,909,049 10/1952 Rees ..... 66/77
2,960,854 11/1960 Eberl ..... 66/71
3,007,326 11/1961 Porter ..... 66/109
3,973,413 8/1976 Tichenor ..... 66/90 X

*Primary Examiner*—Clifford D. Crowder
*Assistant Examiner*—John J. Calvert
*Attorney, Agent, or Firm*—Edwin E. Greigg; Ronald E. Greigg

[57] ABSTRACT

The invention relates to a flat knitting machine capable of obtaining a high quality knit fabric excellent in knitting property (ease of knitting), by variably adjusting the knock-over timing when knitting, depending on the characteristics of knitting threads and knitted texture of the knit fabric. The characteristics of the knit fabric depends upon the sinkers which have at least one aperture near a tip end of the sinkers. A knitting thread stopping wire rod is passed through one aperture near the tip end of the sinker. The knit fabric depends upon which aperture near the tip end that the knitting thread stopping wire rod is passed.

4 Claims, 5 Drawing Sheets

FLAT KNITTING MACHINE HAVING FUNCTION FOR ADJUSTING KNOCK-OVER TIMING

BACKGROUND OF THE INVENTION

The present invention relates to a flat knitting machine having function for adjusting knock-over timing capable of adjusting the knock-over timing when knitting depending on the characteristics of knitting threads and knitted texture of the knit facric.

Generally, as knock-over timing of knitting in a flat knitting machine, after the knitting needle planted in the needle bed is related to a position capable of clearing the stopped former loop, the knitting thread supplied into the hook of this knitting needle is pulled in and lowered, and the new loop surpasses the former loop to form a stitch. In other words, the former loop stopped on the knitting needle is, when forming a next new loop, knocked over together with the knitting needle in its pulling-in process, so that a complete stitch is formed.

This knock-over timing is automatically determined by the position of a hole drilled near the front tip of the sinker in order to install the knitting thread stopping wire rod. It means that the ratio of the sinker loop and needle loop forming the stitch to one stitch is constant in the stitches of the continuously knitted courses.

However, the knock-over timing is significantly influenced by the characteristics of the knitting threads and others. For example, slipping of knitting thread, elongation, twist, dyeing property, and difference in after-treatment may affect whether the materials are the same or different. They are also found to affect the shapes of the sinker loop and needle loop forming the stitches at the same time.

Hitherto, therefore, whenever the type or thickness of the knitting thread is changed, the knitting parameters that are considered to affect the timing (thead feed tension, waxing, knit fabric winding-down tension, needle hook shape) have been revised or modified to adjust to proper suited knitting paramenters.

This work, however, required much skill and labor, and in spite of the skill and labor spent, sufficient effects could not be obtained.

OBJECT AND SUMMARY OF THE INVENTION

The invention is devised in the light of the above problems and it is hence a primary object of the invention to present a flat knitting machine having a function for adjusting knock-over timing in order to obtain a high quality knit fabric excellent in knitting performance (ease of knitting), by variably adjusting the knock-over timing when knitting, depending on the characteristics of the knitting threads and the knitted texture of the knit fabric.

DETAILED DESCRIPTION OF THE PREFERRED EMBODIMENTS

Referring now to FIG. 1 to FIG. 8, some of the preferred embodiments of the invention are described in detail below.

Figure 1:
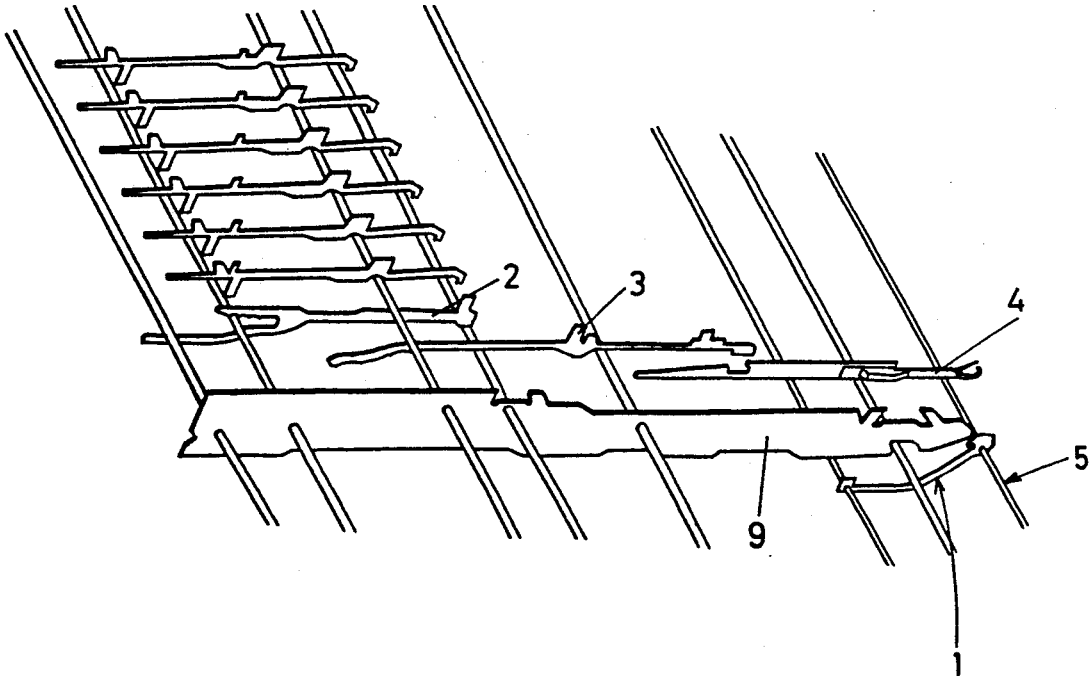
FIG. 1 is a schematic perspective view for explaining the portion relating to the invention of a flat knitting machine.
Figure 2:
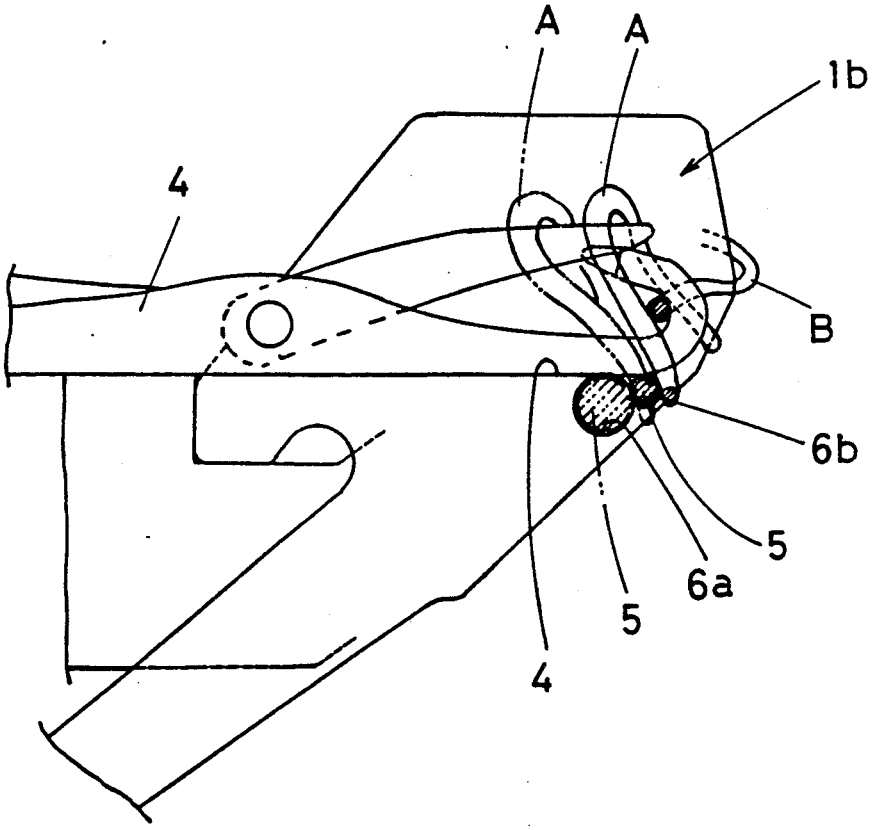
FIG. 2 is an explanatory drawing showing the knock-over state of essential parts relating to the invention.

As shown in FIG. 1, in a flat knitting machine, sinkers 1 are fixed on the top of a needle bed at specific intervals in parallel with each other. Multiple knitting needles 4 are mounted on a needle bed slidably along the sinkers 1 and needle plates 9, each of the knitting needles 4 being controlled by a cam mechanism of a carriage (not shown) running on the needle bed in a longitudinal direction by means of a select jack 2 and a jack 3. A knitting thread stopping wire rod 5 is provided below hook portions of the knitting needles 4 in operation of knock-over and it pierces through the sinkers 1 to be orthogonal to the sliding direction of the knitting needles 4. Sinkers 1*a*, 1*b*, 1*c* in the individual embodiments shown in FIG. 3 to FIG. 8 are individually disposed as the sinkers 1 in FIG. 1, and the knitting thread stopping wire rod 5 is designed to be freely set in and out of the holes pierced in the sinkers 1*a*, 1*b* or 1*c*.

Figure 4:
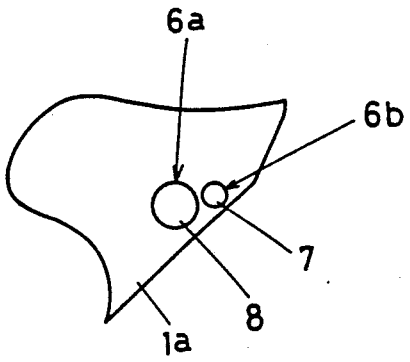
FIG. 4 is an enlarged view of essential parts in FIG. 3.
Figure 3:
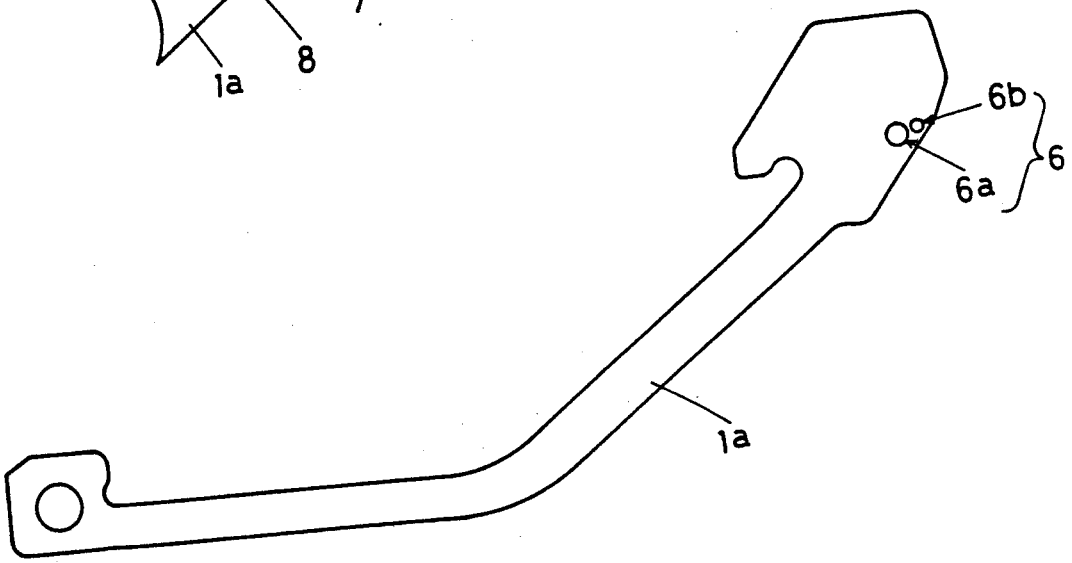
FIG. 3 is a front view showing a sinker 1*a* in a first embodiment.
Figure 6:
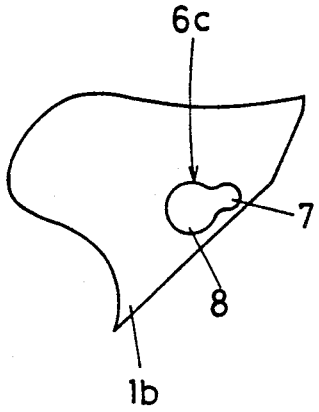
FIG. 6 is an enlarged view of essential parts in FIG. 5, and FIG. 7, FIG. 8 are enlarged explanatory drawings of a sinker 1*c* in a third embodiment.
Figure 5:
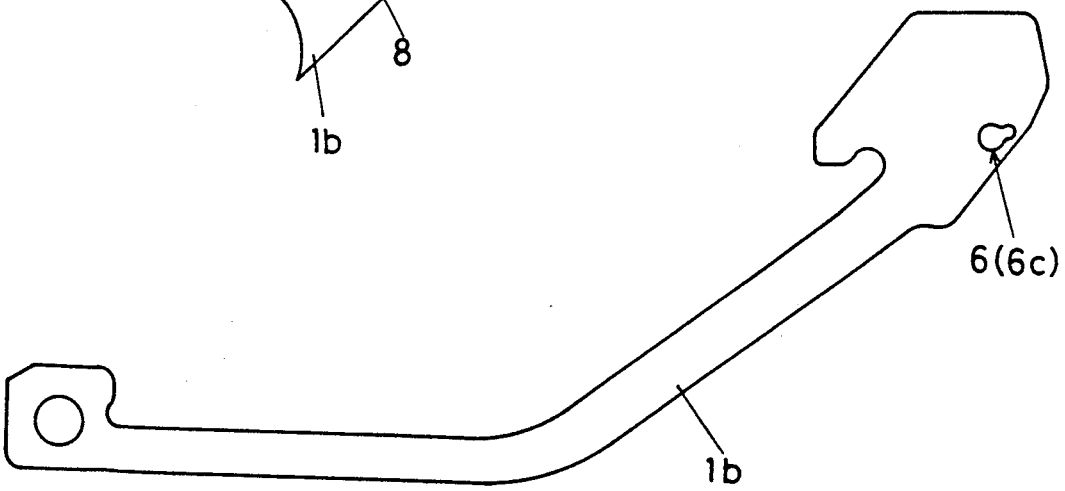
FIG. 5 is a front view showing a sinker 1*b* in a second embodiment.

That is, in the sinker la of the first embodiment as shown in FIG. 3 and FIG. 4, large and small holes 6*a*, 6*b* are pierced near the front tip of the sinker by deviating the position slightly in the sliding direction of the knitting needles 4. In the sinker 1*b* of the second embodiment shown in FIG. 5 and FIG. 6, large and small communicating holes 6*c* in a snowman shape on the whole are opened near the front tip of the sinker as shown in the drawings By putting the knitting thread stopping wire rods 5 into these holes 6*a*, 6*b*, holes 6*c*, depending on the characteristics of the knitting threads and knitted texture of knit fabric, the abutting position to the knitting thread stopping wire rod 5 of the knitting thread loop A may be changed as showned in FIG. 2, thereby making it possible to adjust to the optimun knock-over timing when the knitting thread loop A (former loop) is cleared from the hook 4*a* of the knitting needle 4 when forming a stitch.

Figure 7:
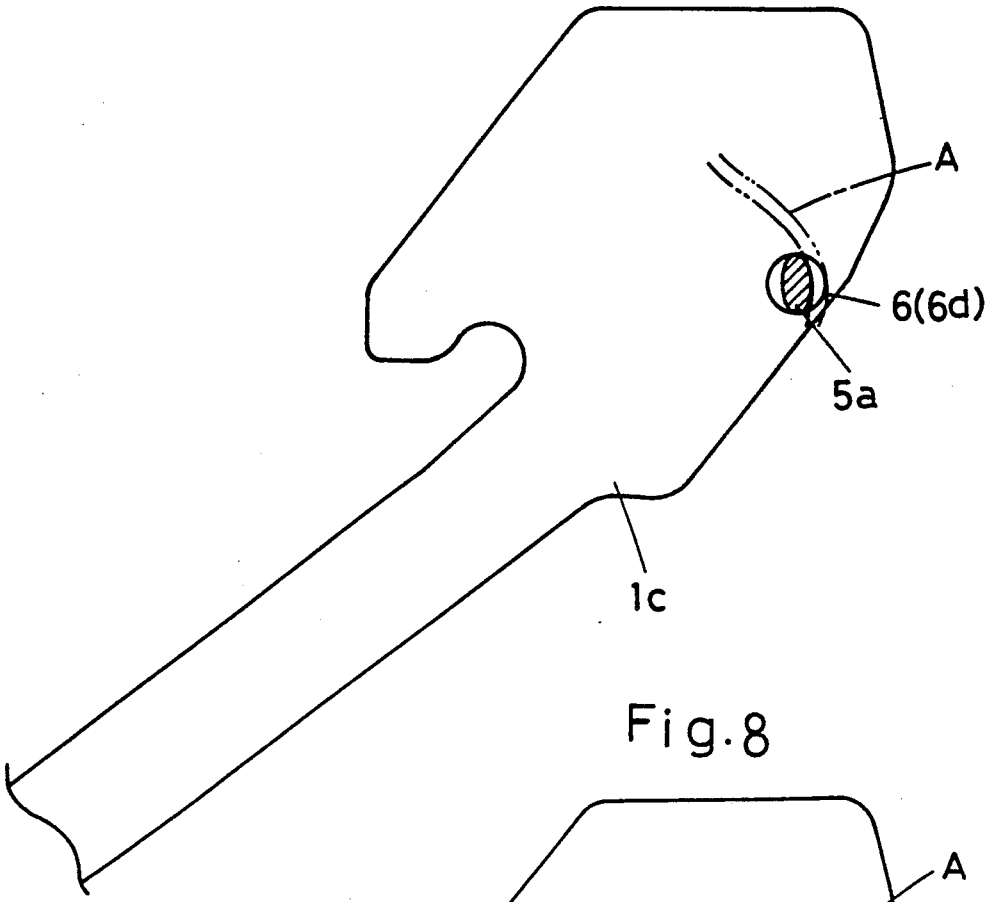
Figure 8:
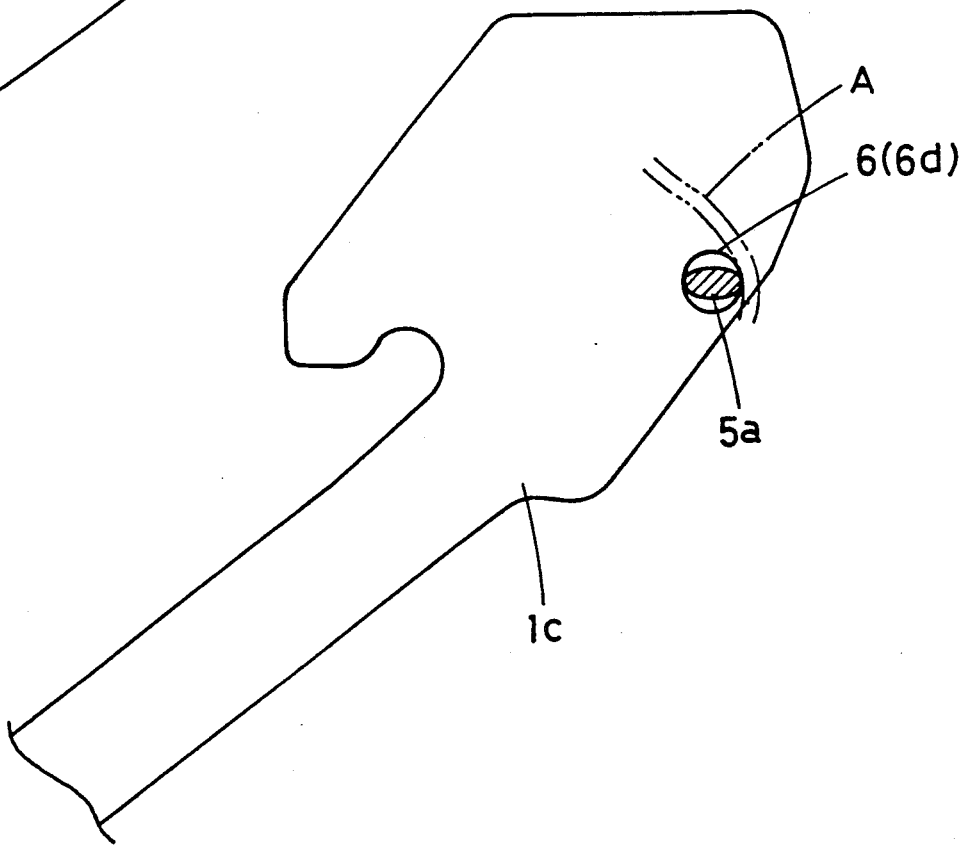

The embodiment shown in FIG. 7, and FIG. 8 is a third embodiment, and in this embodiment, in order to adjust the knock-over timing depending on the characteristics of knitting threads and knitted texture of knit fabric, the knitting thread stopping wire rod 5 in an elliptical section is inserted in the hole 6*d* pierced near the front tip of the sinker 1*c*, and by attaching by arbitrarily varying the attaching position in the hole 6*d* of this knitting thread stopping wire rod 5*a*, that is, the inserting angle (method) of the knitting thread stopping wire rod 5*a* as shown in the drawing, the abutting position of the knitting thread loop A and the knitting thread stopping wire rod 5*a* when knitting may be properly changed in the longtudinal direction of the sinker 1*c*. In this embodiment, meanwhile, the hole 6*d* may be disposed in a plurality same as in the foregoing embodiments, or plural communicating holes may be opened, and the knitting thread stopping wire rod 5*a* in the elliptical shape may be set in the desired hole or in the desired position of the communicating holes.

By properly setting the knitting thread stopping wire rods 5, 5*a* in the holes of the sinkers 1*a*, 1*b*, 1*c* in the foregoing embodiments, the following actions and effects may be obtained (see FIG. 2 to 6).

More specifically, even in the same knitted texture, if differing in the characteristics of knitting threads, for example, in the case of the knitting thread low in stretchability or the knitting thread of excellent slipping property (small in surface friction coefficient), by setting the knitting thread stopping wire rod 5 in the hole closer to the front tip of the sinkers 1*a*, 1*b* in the first and second embodiments, a beautiful knit fabric with uniform stitches will be obtained.

That is, as shown above, by setting the knitting thread stopping wire rod 5 in the hole 7 closer to the front tip of the sinkers 1*a*, 1*b*, the knock-over timing of the knitting loop A is quickened, while the stitch being formed presently is less affected by the winding-down tension. Owing to the quickness of knock-over by these characteristics of the knitting thread itself, it is possible to form the stitch more natually than in the state of easier winding-down effect by keeping the knitting thread stopping wire rod 5 away from the front tip of the needle bed (the state in which the winding-down tension may directly affect the stitch formation), and therefore the stitches become very orderly and neat, and a knit fabric of high quality may be obtained.

On the other hand, even in the same knitted texture, in the case of the knitting thread high in stretchability or poor in slipping performance (large in surface friction coefficient), if knitted by setting thread stopping wire rod 5 in the hole 7 closer to the front tip of the sinkers 1*a*, 1*b* of the first embodiment and second embodiment as mentioned above, the frictional resistance increases at the contact point of the loops A and B when the new loop B rides over the former loop A (knitting thread loop A) at the time of knock-over, and the knock-over timing of the former loop A (knitting thread loop A) is delayed by the corresponding portion, and the ratio of the needle loop and sinker loop may be disturbed or the movement of the knitting thread still moving in the formed loop may be influenced, thereby adversely affecting the uniformity of the stitches.

Accordingly, by setting the knitting thread stopping wire rod 5 in the hole 8 opened at a position remote from the front tip of the needle bed, stitches may be formed in a state where the winding-down tension may take effect easily, and therefore the delay of the knock-over due to poor slipping property of the knitting thread itself may be compensated by the positive utilization of the winding-down tension, and hence knit fabrics of high quality may be obtained by eliminating the above adverse effects.

Next, when the knitted texture is different although the knitting threads are the same, for example, in a fashioning knit for sequentially widening or narrowing the knitting width, particularly when narrowing the knitting width, if the knitting thread stopping wire rod 5 is set in the hole 8 opened at a position remote from the front tip of the sinkers 1*a*, 1*b*, the effect of the winding-down tension is large, and as the knitting width becomes narrower and narrower, it bocomes difficult to adjust the winding-down tension, and it also becomes difficult to reduce the stitches at both ends of the knit fabric, further it is likely to be broken.

Accordingly, by setting the knitting thread stopping wire rod 5 in the hole 7 opened at a position close to the front end of the sinkers 1*a*, 1*b*, the effect of the winding-down tension becomes less, and therefore even if some strong winding-down tension is actuated, the chance of immediate adverse effect on the knit fabric is low.

On the other hand, even by the same knitting threads, in the case of knitted texture mixing rib stitch and plain stitch at various locations in the wale direction such as in the knit-in pattern, if the knitting thread stopping wire rod 5 is placed in the hole 7 made at a position closer to the front tip of the sinkers 1*a*, 1*b*, as known from the example above, the winding-down tension hardly acts on the knit fabric, and hence the plain stitch loop in a loosened state as compared with the rib stitch loop may finally lead to double biting even if knocked over from the hook part of the needle front end.

Accordingly, by setting thread stopping wire rod 5 in the hole 8 drilled at a position remote from the front tip of the sinkers 1*a*, 1*b*, the effect of the winding-down tension is increased, and such double biting may be avoided, and a knit fabric of excellent high quality may be obtained.

Incidentally, in order to obtain the above action and effect by the sinker 1*a* and knitting thread stopping wire rod 5*a* in the third embodiment, as mentioned above, instead of setting the knitting thread stopping wire rod 5 in the hole 8 made in a position remote from the front the front end of the sinkers 1*a*, 1*b*, for example, the knitting thread stopping wire rod 5*a* which has an elliptical section may be inserted as shown in FIG. 7, so that the same action and effect may be obtained.

Moreover, instead of setting the knitting thread stopping wire rod 5 in the hole 7 opened in a position close to the front tip of the sinkers 1*a*, 1*b*, for example as shown in FIG. 8, by inserting the knitting thread stopping wire rod 5*a* which has an ellipical section, the same action and effect may be obtained.

What is claimed is:

1. A flat knitting machine having a function for adjusting knock-over timing comprising;

a plurality of sinkers fixed on a top of a needle bed at specific intervals in parallel with each other, each of said sinkers including at least one aperture near a front tip of said sinkers, multiple knitting needles mounted on the needle bed and slidable along the sinkers, each of the knitting needles being controlled by a cam mechanism of a carriage running on the needle bed, and a knitting thread stopping wire rod is provided below hook portions of the knitting needles in operation of knock-over, the knitting thread stopping wire rod extending through at least one of said at least one aperture in the sinkers to be orthogonal to the sliding direction of the knitting needles, wherein a setting position of the knitting thread stopping wire rod in the sinkers is made adjustable so that an abutting position of a knitting thread loop on the knitting thread stopping wire rod is changed in the sliding direction of the knitting needles.

2. A flat knitting machine having a function for adjusting knock-over timing according to claim 1 wherein each of said sinkers includes more than one aperture near the front tip, and the knitting thread stopping wire rod is designed to be selectively set in one of said more than one aperture near the tip of each of said sinkers.

3. A flat knitting machine having a function for adjusting knock-over timing according to claim 1 wherein each of said sinkers include one aperture near the front tip in which, said one aperture is formed with one portion which is larger than another portion that communicates therewith, and the knitting thread stopping wire rod is designed to be selectively set in said one aperture near the front tip of the sinkers.

4. A flat knitting machine having a function for adjusting knock-over timing according to claim 1, where each of said sinkers include more than one aperture near the tip end, said knitting thread stopping wire rod has an elliptical cross section, and said knitting thread stopping rod is placed in one of said apertures near the tip end at an arbitrary intersecting angle.

* * * * *